US010688804B2

(12) United States Patent
Qian et al.

(10) Patent No.: US 10,688,804 B2
(45) Date of Patent: Jun. 23, 2020

(54) PRINTING APPARATUSES

(71) Applicant: Hewlett-Packard Development Company, L.P., Houston, TX (US)

(72) Inventors: Li Qian, Sant Cugat del Valles (ES); Andreas Müller, Barcelona (ES); Carles Ruiz Floriach, Mataro (ES); Guillem Roig, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/760,967

(22) PCT Filed: Nov. 5, 2015

(86) PCT No.: PCT/US2015/059193

§ 371 (c)(1),
(2) Date: Mar. 16, 2018

(87) PCT Pub. No.: WO2017/078718

PCT Pub. Date: May 11, 2017

(65) Prior Publication Data

US 2018/0244070 A1 Aug. 30, 2018

(51) Int. Cl.
*B41J 2/195* (2006.01)
*B41J 2/175* (2006.01)
(Continued)

(52) U.S. Cl.
CPC ..... *B41J 2/195* (2013.01); *B41J 2/0458* (2013.01); *B41J 2/04528* (2013.01);
(Continued)

(58) Field of Classification Search
CPC .... B41J 2/195; B41J 2/04528; B41J 2/04563; B41J 2/04558; B41J 2/175
See application file for complete search history.

(56) References Cited

U.S. PATENT DOCUMENTS 4,827,279 A 5/1989 Lubinsky et al.
5,138,334 A 8/1992 Rowe et al.
(Continued)

FOREIGN PATENT DOCUMENTS

CN 1652939 8/2005
CN 104070802 10/2014
WO WO-2015041646 3/2015

OTHER PUBLICATIONS

Business Productivity with Robust Colour Performance, (Web Page) <https://media.lexmark.com/www/doc/en_XM/Lexmark-X792de.pdf >.

*Primary Examiner* — Jason S Uhlenhake
(74) *Attorney, Agent, or Firm* — HP Inc. Patent Department

(57) ABSTRACT

Examples herein provide a method. The method includes preconditioning a printing apparatus, including: increasing a temperature of an inkjet printhead in a print zone in the printing apparatus to a first temperature higher than or equal to about a steady state printhead temperature; and increasing a temperature of the print zone such that a portion of a print medium disposed over a portion of a platen in the print zone is at a second temperature higher than or equal to about a steady state print zone temperature. The method further includes disposing, using the printhead, an ink at the steady state printhead temperature onto the portion of the print medium to form an image thereon.

19 Claims, 5 Drawing Sheets

(51) Int. Cl.
*B41J 2/045* (2006.01)
*B41J 11/00* (2006.01)
*B41J 29/38* (2006.01)

(52) U.S. Cl.
CPC ..... *B41J 2/04563* (2013.01); *B41J 2/175* (2013.01); *B41J 11/002* (2013.01); *B41J 29/38* (2013.01)

(56) References Cited

U.S. PATENT DOCUMENTS

| | | | | |
|---|---|---|---|---|
| 5,510,822 | A | 4/1996 | Vincent et al. | |
| 5,548,308 | A * | 8/1996 | Nagatomo | B41J 2/04528 347/35 |
| 6,318,828 | B1 | 11/2001 | Barbour et al. | |
| 6,906,736 | B2 | 6/2005 | Bouchard et al. | |
| 7,137,694 | B2 | 11/2006 | Ferran et al. | |
| 7,770,997 | B2 | 8/2010 | Richard et al. | |
| 2002/0149639 | A1 | 10/2002 | Crivelli et al. | |
| 2012/0176439 | A1 * | 7/2012 | Kanai | B41J 2/2107 347/17 |
| 2012/0206530 | A1 * | 8/2012 | Mizes | B41J 2/2146 347/19 |
| 2012/0249639 | A1 | 10/2012 | Ozawa et al. | |
| 2013/0135380 | A1 * | 5/2013 | Oonuki | B41J 3/543 347/17 |
| 2014/0292885 | A1 * | 10/2014 | Yamazaki | B41J 11/002 347/17 |
| 2014/0320563 | A1 * | 10/2014 | Gracia Verdugo | B41J 2/04563 347/17 |

* cited by examiner

PRINTING APPARATUSES

BACKGROUND

In a printing apparatus, portions of an image printed onto a print medium may be printed by different printing units in the apparatus such as a printhead or die. Variations in printing may occur between the outputs of a plurality of printing units. For large scale printing, a printing technique called tiling may be used. The technique may involve cutting a print job into smaller stripes which are then printed on the printer and stuck side by side according to a predetermined order of how the print job is cut.

BRIEF DESCRIPTION OF THE DRAWINGS

The drawings are provided to illustrate various examples of the subject matter described herein in this disclosure (hereinafter "herein" for short, unless explicitly stated otherwise) related to a printing apparatus and are not intended to limit the scope of the subject matter. The drawings are not necessarily to scale.

DETAILED DESCRIPTION

Figure 1:
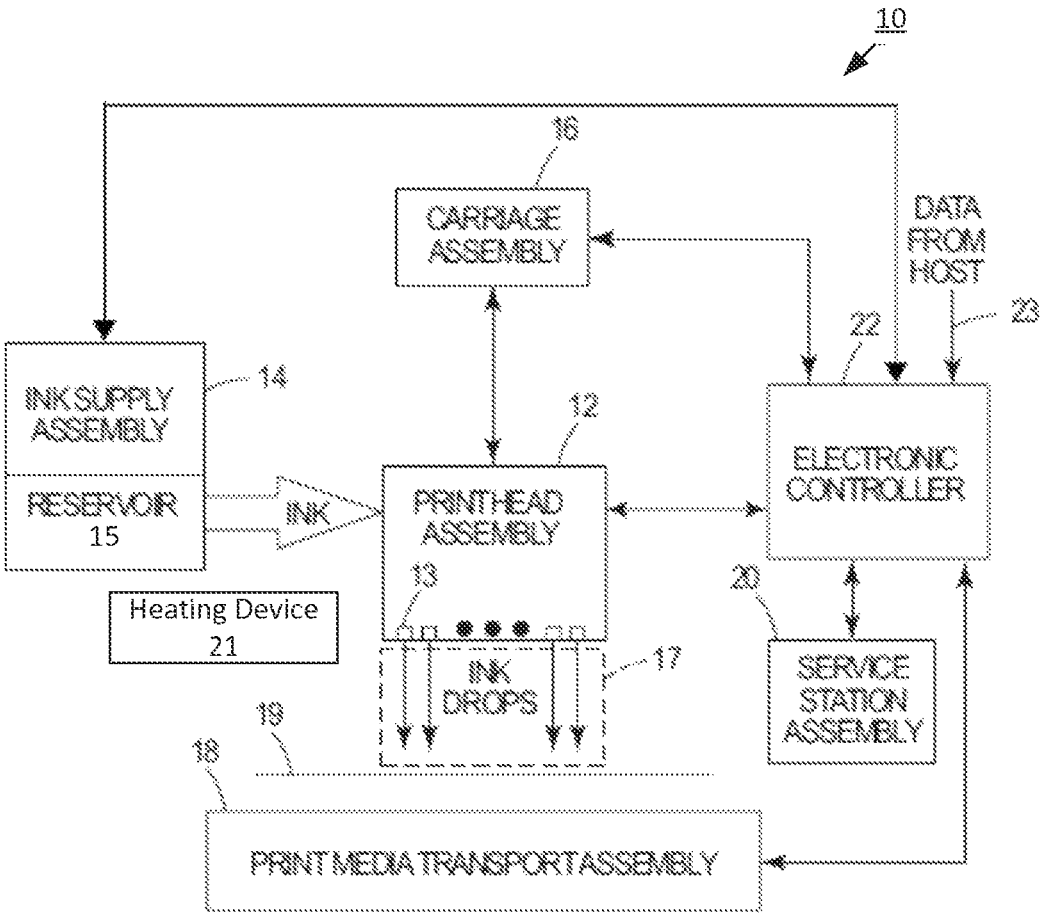
FIG. 1 provides a schematic showing an example printing apparatus described herein.

The printers designed for large printing service provider ("PSP"), particularly those targeting the sign and display ("S&D") market may be capable of keeping production of prints with minimal intervention for a long period of time (from days to months). In some instances, this capability may enable applications such as outdoor billboard and building wrapper involving a large amount of printing. Due to the size limitation of the commercially available printers, a printing technique called tiling may be used. In one example, tiling may involve cutting the print job into smaller stripes which are small enough to be handled by the printer, printed by the printer, and stuck side by side according to a predetermined order. One important attribute to achieve a desirable level of quality for tiling is the color consistency along long run of the print job.

In some instances, the solutions to achieve color matching, or color consistency, include to reduce the heat applied onto the printheads by using a print mode with a larger number of passes, involving lowering the printhead firing frequency with the same amount of ink fired onto the print medium; and/or to lower the radiation from the drying lamp(s) to the printheads in the carriage during printing. This solution involves also printing primer plots for a few meters to warm up the system and steadily warm up the printheads before the actual print job commences. These meters of print medium used for primer plots generally become wasted.

In view of the aforementioned challenges related to color consistency, the Inventors have recognized and appreciated the advantages of preconditioning a printing apparatus. Following below are more detailed descriptions of various examples related to a printing apparatus, particularly preconditioning an apparatus to achieve robust color consistency in a long print job. The various examples described herein may be implemented in any of numerous ways.

Provided in one aspect of the examples is a method, comprising: preconditioning a printing apparatus, comprising: increasing a temperature of an inkjet printhead in a print zone in the printing apparatus to a first temperature higher than or equal to about a steady state printhead temperature; and increasing a temperature of the print zone such that a portion of a print medium disposed over a portion of a platen in the print zone is at a second temperature higher than or equal to about a steady state print zone temperature; and disposing, using the printhead, an ink at the steady state printhead temperature onto the portion of the print medium to form an image thereon.

Provided in another aspect of the examples is a non-transitory machine-readable medium stored thereon instructions, which when executed, cause preconditioning, using a processor, a printing apparatus, comprising: increasing a temperature of an inkjet printhead in a print zone in the printing apparatus to a first temperature higher than or equal to about a steady state printhead temperature; and increasing a temperature of the print zone such that a portion of a print medium disposed over a portion of a platen in the print zone is at a second temperature higher than or equal to about a steady state print zone temperature; and disposing, using the printhead, an ink at the steady state printhead temperature onto the portion of the print medium to form an image thereon.

Provided in another aspect of the examples is a printing apparatus, comprising: a print zone, in which a heater is to increase a temperature of a printhead to a first temperature higher than or equal to about a steady state printing temperature; and a heating device to increase a temperature of the print zone such that a portion of a print medium disposed over a portion of a platen in the print zone is at a second temperature higher than or equal to about a steady state print zone temperature; wherein the printhead is to dispose an ink at the steady state printhead temperature onto the portion of the print medium to form an image thereon.

To the extent applicable, the terms "first," "second," "third," etc. herein are merely employed to show the respective objects described by these terms as separate entities and are not meant to connote a sense of chronological order, unless stated explicitly otherwise herein.

Printing Apparatus

FIG. 1 illustrates one example of a printing apparatus 10. The printing apparatus may be an inkjet printing system. In one example, the printing apparatus is a thermal inkjet printer. The printer may be, for example, one of the Latex® family printers commercially available from HP, Inc., U.S.A. The printing apparatus 10 may include a fluid ejection assembly, such as printhead assembly 12, and a fluid supply assembly, such as ink supply assembly 14. In the illustrated example, printing apparatus 10 also includes a carriage assembly 16, a print media transport assembly 18, a service station assembly 20, and an electronic controller 22.

Printhead assembly 12 includes at least one fluid ejection device which eject drops of ink or fluid through a plurality of orifices or nozzles 13—e.g., at least one printhead. Only for the sake of convenience, "printhead" is used as a representative example of a fluid ejection device or even to represent the printhead assembly herein, but it is readily understood that other types of fluid ejection devices may be suitable. The printhead assembly 12 may comprise a heater (not shown) to increase the temperature of the printhead (or printhead assembly as a whole) to a predetermined temperature—this is discussed further below. This heater may comprise a warming device, which may comprise a heater transducer or a resistor. The heater may be employed to produce power pulses. In one example, each resistor is individually addressable to heat and vaporize ink in one of the plurality of channels. As voltage is applied across a selected resistor, a vapor bubble may grow in the associated channel and initially bulges from the channel orifice, followed by collapse of the bubble. The ink within the channel may then retract and separate from the bulging ink, to form a droplet moving in a direction away from the channel orifice and towards the recording medium. When the ink droplet hits the recording medium, a drop or spot of ink is deposited. The channel is then refilled by capillary action, which, in turn, draws ink from a supply container of liquid ink.

Through the ejection of drops of ink, the ink may dispose the ink onto a print medium (or a portion thereof). The disposing process, or "printing", may be carried out at a specific condition (e.g., temperature) of the print zone. The steady state temperature may encompass the steady state printhead temperature (or "Tss,ph") and the steady state print zone temperature (or "Tss,pz"). In one example, this is known as a steady state printing temperature. In one example, the ink is disposed over a print medium, such as a print medium 19, so as to form an image on the print medium 19. Print medium 19 may include any type of suitable sheet material, such as paper, card stock, transparencies, Mylar, fabric, and the like. In one example, nozzles 13 are arranged in at least one column or array such that properly sequenced ejection and disposition of ink from nozzles 13 may cause characters, symbols, and/or other types of graphics or images to be printed upon the print medium 19 as printhead assembly 12 and print medium 19 are moved relative to each other.

In this example, ink supply assembly 14 supplies ink to printhead assembly 12 and includes a reservoir 15 for storing ink. As such, in one example, ink flows from reservoir 15 to printhead assembly 12. In one example, printhead assembly 12 and ink supply assembly 14 are housed together in an inkjet or fluid-jet print cartridge or pen. In another example, ink supply assembly 14 is separate from printhead assembly 12 and supplies ink to printhead assembly 12 through an interface connection (e.g., a supply tube).

In this example, carriage assembly 16 positions printhead assembly 12 relative to print media transport assembly 18 and print media transport assembly 18 positions print medium 19 relative to printhead assembly 12. The print media transport assembly may comprise a platen (not shown). In one example, the platen is a stationary platen to extend under and support the print medium 19 in close proximity to the printhead in the print zone 17 as the print medium 19 is drawn along an advancement direction. A print zone 17 herein may be defined as an area adjacent to nozzles 13 between and including printhead assembly 12 and print medium 19. In one example, printhead assembly 12 is a scanning type printhead assembly such that carriage assembly 16 moves printhead assembly 12 relative to print media transport assembly 18. In another example, printhead assembly 12 is a non-scanning type printhead assembly such that carriage assembly 16 fixes printhead assembly 12 at a prescribed position relative to print media transport assembly 18.

In this example, the printing apparatus may further comprise a heating device 21. The heating device may be employed to increase the temperature of the print zone 17 such that a portion of a print medium 19 disposed over a portion of a platen (in the print media transport assembly 18) in the print zone is at a second temperature higher than or equal to about a steady state print zone temperature. In some instances, the heating of the print zone by the heating device 21 allows both the portion of the portion medium and the portion of the platen in the print zone to be both at the second temperature. In one example, the heating of the print zone by the heating device 21 allows the entire print medium and/or the entire platen to be at the second temperature.

A printing apparatus may further comprise servicing components. For example, FIG. 1 shows that service station assembly 20 provides for spitting, wiping, capping, and/or priming of printhead assembly 12 in order to maintain a functionality of printhead assembly 12 and, more specifically, nozzles 13. For example, service station assembly 20 may include a rubber blade or wiper which is periodically passed over printhead assembly 12 to wipe and clean nozzles 13 of excess ink. In addition, service station assembly 20 may include a cap which covers printhead assembly 12 to protect nozzles 13 from drying out during periods of non-use. In addition, service station assembly 20 may include a spittoon into which printhead assembly 12 ejects ink to insure that reservoir 15 maintains an appropriate level of pressure and fluidity, and insure that nozzles 13 do not dog or weep. Functions of service station assembly 20 may include relative motion between service station assembly 20 and printhead assembly 12.

In the printing apparatus as shown in FIG. 1, electronic controller 22 communicates with printhead assembly 12, carriage assembly 16, print media transport assembly 18, and/or service station assembly 20. Thus, in one example, when printhead assembly 12 is mounted in carriage assembly 16, electronic controller 22 and printhead assembly 12 communicate using carriage assembly 16. Electronic controller 22 also communicates with ink supply assembly 14 such that, in one example, a new (or used) ink supply may be detected, and a level of ink in the ink supply may be detected.

Electronic controller 22 receives data 23 from a host system, such as a computer, and may include memory for temporarily storing data 23. Data 23 may be sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one example, electronic controller 22 provides control of printhead assembly 12 including timing control for ejection of ink drops from nozzles 13. As such, electronic controller 22 defines a pattern of ejected ink drops which form characters, symbols, and/or other graphics or images on print medium 19. Timing control and, therefore, the pattern of ejected ink drops, is determined by the print job commands and/or command parameters. In one example, logic and drive circuitry forming a portion of electronic controller 22 is located on printhead assembly 12. In another example, logic and drive circuitry forming a portion of electronic controller 22 is located off printhead assembly 12. The electronic controller 22 also may provide control of heating the heater in the printhead assembly 12 and/or the heating device 21, such as according to a predetermined preconditioning protocol.

Method of Printing

Figure 2:
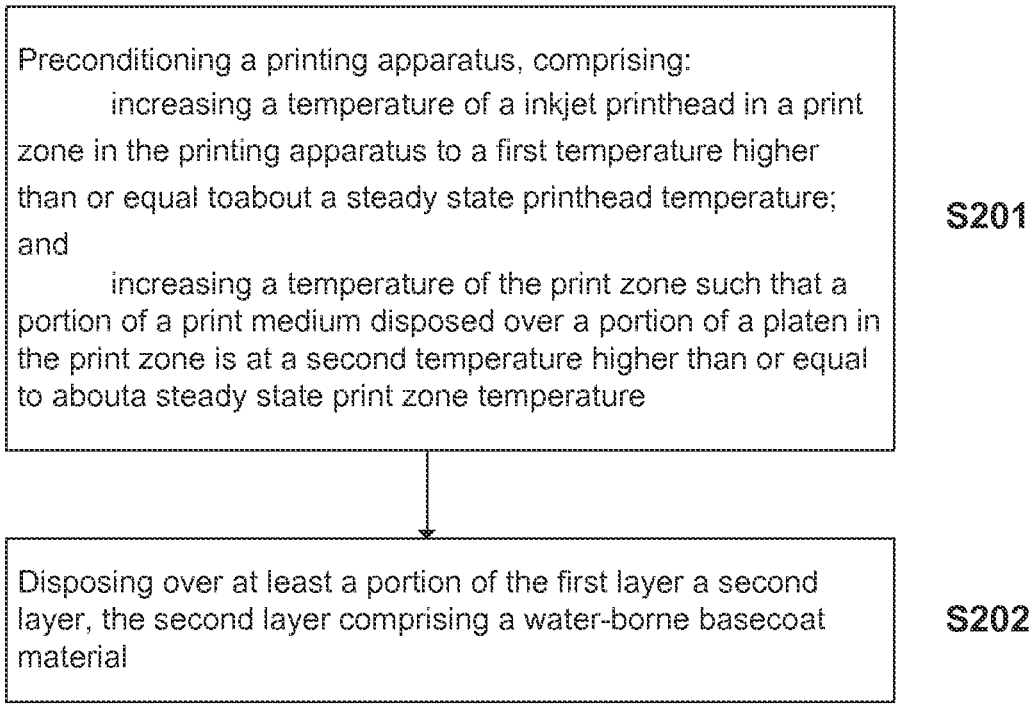
FIG. 2 provides a flowchart showing an example method described herein.

FIG. 2 illustrates an example printing method descried herein. Any of the printing methods described herein may be carried out using the printing apparatus described herein. The method as shown in FIG. 2 comprises a process of preconditioning a printing apparatus (S201). The preconditioning may comprise increasing a temperature of an inkjet printhead in a print zone in the printing apparatus to a first temperature higher than or equal to about a steady state printhead temperature. The process of increasing the temperature of the inkjet printhead may involve at any suitable techniques. For example, the process may involve trickle warming.

Trickling warming in one example is described as follows: To reduce the effect of temperature variance from the beginning of printing to another point in the printing process, a warming device, such as the heater in the printhead assembly described above, may be employed. A warming device is used to raise the temperature of the printhead. The printhead assembly may include a mechanism to control the electrical current to the firing resistors so that their energy is below the threshold to eject an ink drop. This mechanism may communicate with an electrical controller, such as that shown in FIG. 1. This warming device may be a power field effect transistor ("FET"). The device may provide a capability to warm the printhead assembly to the desired "first temperature" (as described herein) before or during printing operations. The process is called "trickle warming" because the printhead assembly allows only a trickle of energy to flow through separate FETs to firing resistors. In one example, the printhead assembly temperature rises until the desired temperature is reached and the warming device is then shut off.

Trickle warming may be carried out by a preconditioning algorithm or routine and be executed in various ways. For example, trickle warming may have a cascading way of different trickle warming settings. One example of a cascading way of different trickle warming settings may include incremental increase of printhead temperature until the desired predetermined temperature is reached. The duration of each increment may have any suitable value. Additionally, trickle warming may have fixed trickle warming settings. For example, fixed trickle warming settings may involve a one-step increase of the printhead temperature of the desired temperature. The desired temperature, or "first temperature," as shown in S201, may be higher than or equal to about the steady state printhead temperature. As discussed below, the term "equal to" about the steady state temperature may encompass the situations of both being "equal to" and "slightly lower than."

A steady state printhead temperature ("Tss,ph") may refer to the temperature of the printhead during printing, the peaks of which temperature profile (which may be oscillating) have remained at least substantially constant (within ±3° C.) for a certain period of time (of any suitable value)—e.g., 1 min, 2 min, etc. The steady state printhead temperature may have any suitable value, depending on the system and parameters employed. For example, the steady state printhead temperature may be between about 35° C. and about 75° C.—e.g., between about 40° C. and about 75° C., between about 45° C. and about 65° C., between about 50° C. and about 60° C., etc. Other values are also possible.

Figure 3:
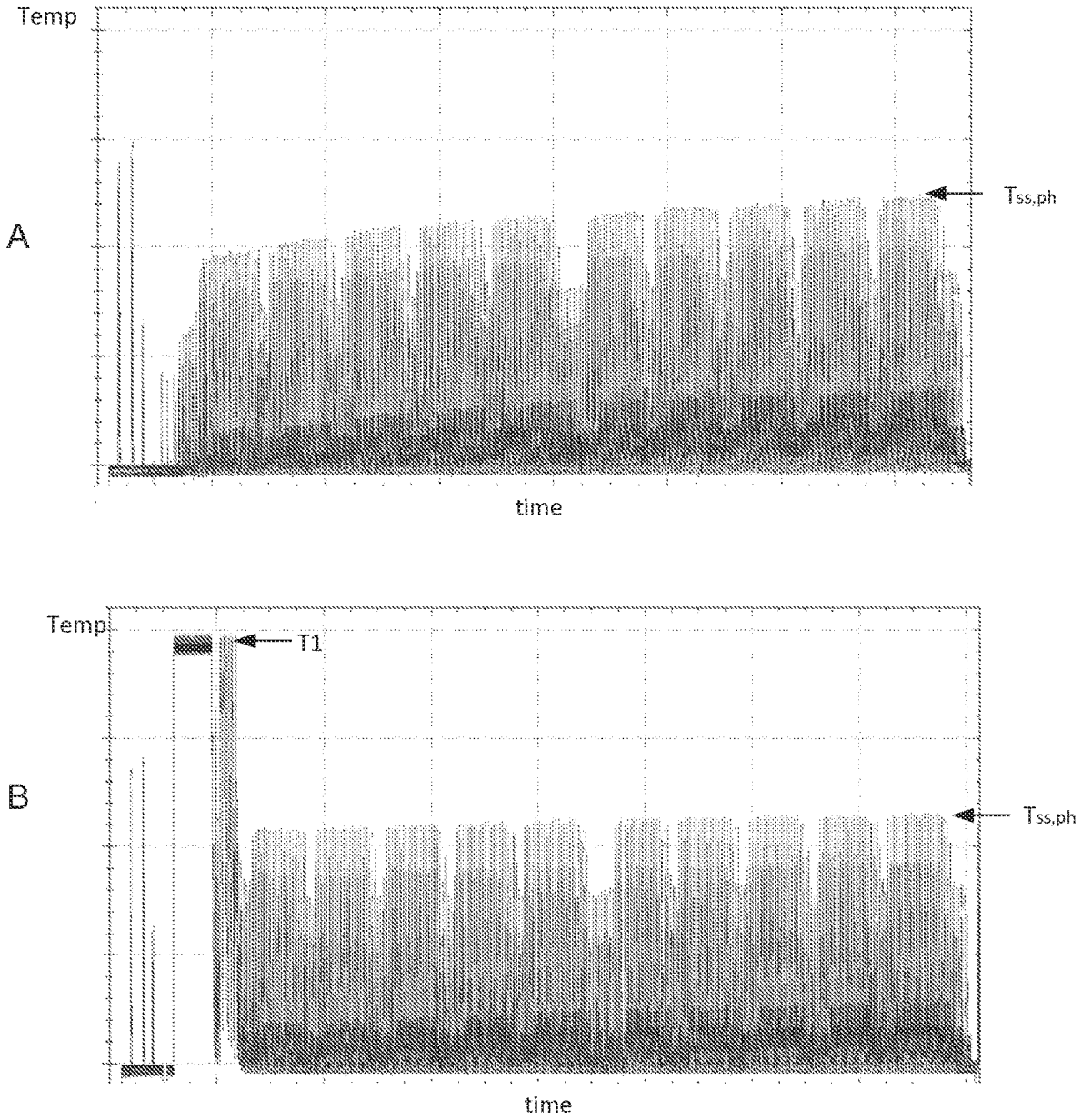
FIGS. 3A-3B provides schematics showing example temperature profiles of a printhead without using the printing method described herein (A) and of another printing method with the method described herein (B).

FIGS. 3A and 3B illustrate a contrast between a printing method without preconditioning the print head as described herein (A) and with preconditioning (B). As shown in FIGS. 3A and 3B, without preconditioning the printhead, the printhead temperature reaches a steady state temperature Tss,ph much later than, if at all, a printing method with preconditioning the printhead. The first temperature T1 may have any suitable value, depending on the system and parameters employed. For example, the first temperature is sufficiently high such that the steady state printhead temperature is reached in, for example, less than or equal to about 5 minutes, for example less than or equal to about 4 minutes, 3 minutes, 2 minutes, or less, since beginning of increasing the temperature of the inkjet printhead. Other lengths of time are also possible. For example, the first temperature may be the same values as those described for the steady state print head temperature. In one example, the first temperature is about 55° C. T1 may be higher than or equal to about Tss,ph. In some instances where T1 is equal to about Tss,ph, T1 may be the same or slighter lower (e.g., ≤5° C.) than Tss,ph.

The preconditioning may further comprise increasing a temperature of the print zone such that a portion of a print medium disposed over a portion of a platen in the print zone is at a second temperature higher than or equal to about a steady state print zone temperature.

A steady state print zone temperature ("Tss,pz") may refer to the temperature of the print zone during printing, the lowest values of which temperature profile (which may be oscillating) have remained at least substantially constant (within ±1° C.) for a certain period of time (of any suitable value)—e.g., 1 min, 2 min, etc. The steady state print zone temperature may have any suitable value, depending on the system and parameters employed. For example, the steady state print zone temperature may be between about 15° C. and about 55° C.—e.g., between about 20° C. and about 50° C., between about 25° C. and about 45° C., between about 30° C. and about 40° C., etc. Other values are also possible.

Figure 4:
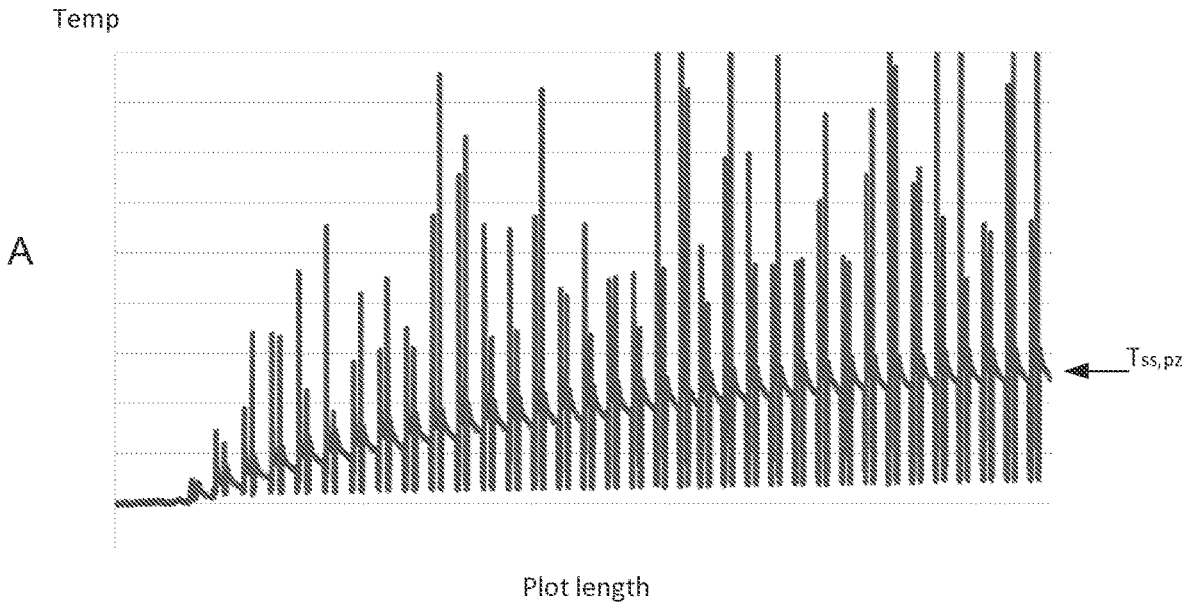
FIGS. 4A-4B provide schematics showing example temperature profiles of the print zone without using the printing method described herein (A) and of another printing method with the method described herein (B).
Figure 4:
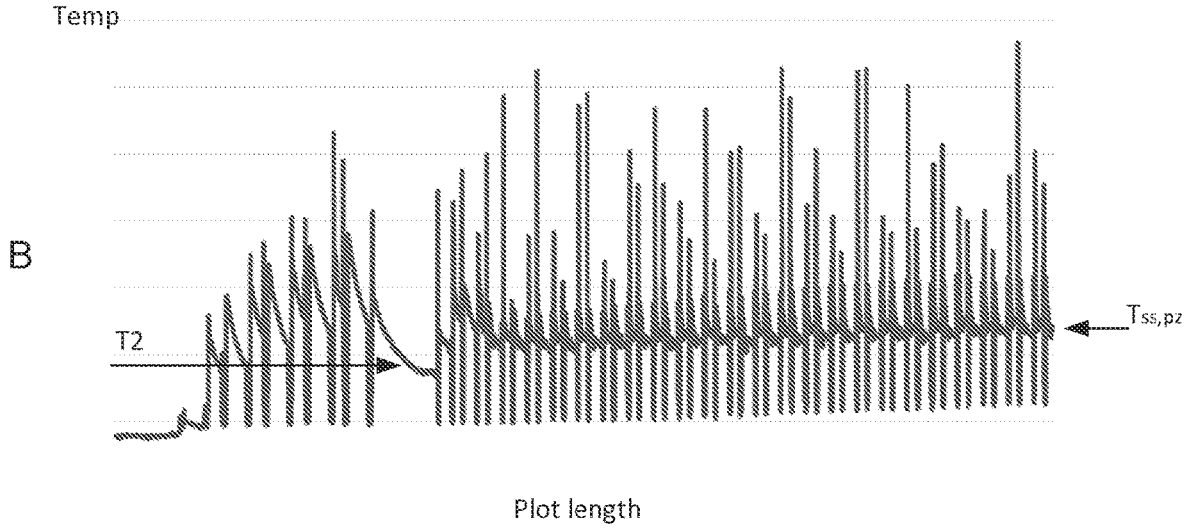

FIGS. 4A and 4B illustrate a contrast between a printing method without preconditioning the print head as descried herein (A) and with preconditioning at T2 (B). As shown in FIGS. 4A and 4B, without preconditioning the printhead, the printhead temperature reaches a steady state temperature Tss,pz much later (as reflected in the much larger plot length wasted, or "primer plot") than, if at all, a printing method with preconditioning the printhead. For example the second temperature may be the same values as those described for the steady state print zone temperature. T2 may be higher than or equal to about Tss,pz. In some instances where T2 is equal to about Tss,pz, T2 may be the same or slighter lower (e.g., ≤5° C.) than Tss,pz.

The temperature of the print zone may be increased by any suitable techniques. For example, it may involve heating, using an energy source (e.g., the heating device as shown in FIG. 1), the print zone such that a portion of the print medium and/or a portion of the platen is at the second temperature. The energy source may comprise any suitable energy source that may emit heat. For example, the energy source may be an infrared source. The energy source may be a heated airflow. In one example, the energy source comprises a heater rod, a lamp, and the like. As described above, by heating the temperature of the print zone, the portion of the print medium in the print zone and/or the portion of the platen underneath the portion of the print medium in the print zone may be brought to the second temperature. In one example, only one of the portion of the print medium and the portion of the platen in the print zone is at the second temperature. In one example, the heating of the print zone allows the entire print medium and/or the entire platen to be at the second temperature.

The increasing of the temperature of the inkjet printhead and the increasing of the temperature of the print zone may take place in sequence (of any suitable order) or in parallel. Because of the different processes involved, the preconditioning process may take any suitable amount of time. For example, the preconditioning may be completed less than or equal to about 10 minutes—e.g., less than or equal to about 8 minutes, about 6 minutes, about 5 minutes, about 4 minutes, about 3 minutes, about 2 minutes, or shorter. Other lengths of time are also possible.

As further shown in FIG. 2, the method may further comprise a process of disposing, using the printhead, an ink at the steady state printhead temperature onto the portion of the print medium to form an image thereon (S202). The disposing process may involve a printing process.

Various examples described herein may be implemented at least in part as a non-transitory machine-readable storage medium (or multiple machine-readable storage media)—e.g., a computer memory, a floppy disc, compact disc, optical disc, magnetic tape, flash memory, circuit configuration in Field Programmable Gate Arrays or another semiconductor device, or another tangible computer storage medium or non-transitory medium) encoded with at least one machine-readable instructions that, when executed on at least one machine (e.g., a computer or another type of processor), cause at least one machine to perform methods that implement the various examples of the technology discussed herein. The computer readable medium or media may be transportable, such that the program or programs stored thereon may be loaded onto at least one computer or other processor to implement the various examples described herein.

The term "machine-readable instruction" is employed herein in a generic sense to refer to any type of machine code or set of machine-executable instructions that may be employed to cause a machine (e.g., a computer or another type of processor) to implement the various examples described herein. The machine-readable instructions may include, but are not limited to, a software or a program. The machine may refer to a computer or another type of processor specifically designed to perform the described function(s), when executed to perform the methods described herein, the machine-readable instructions need not reside on a single machine, but may be distributed in a modular fashion amongst a number of different machines to implement the various examples described herein.

Machine-executable instructions may be in many forms, such as program modules, executed by at least one machine (e.g., a computer or another type of processor). Generally, program modules include routines, programs, objects, components, data structures, etc. that perform particular tasks or implement particular abstract data types. Typically, the operation of the program modules may be combined or distributed as desired in various examples.

Figure 5:
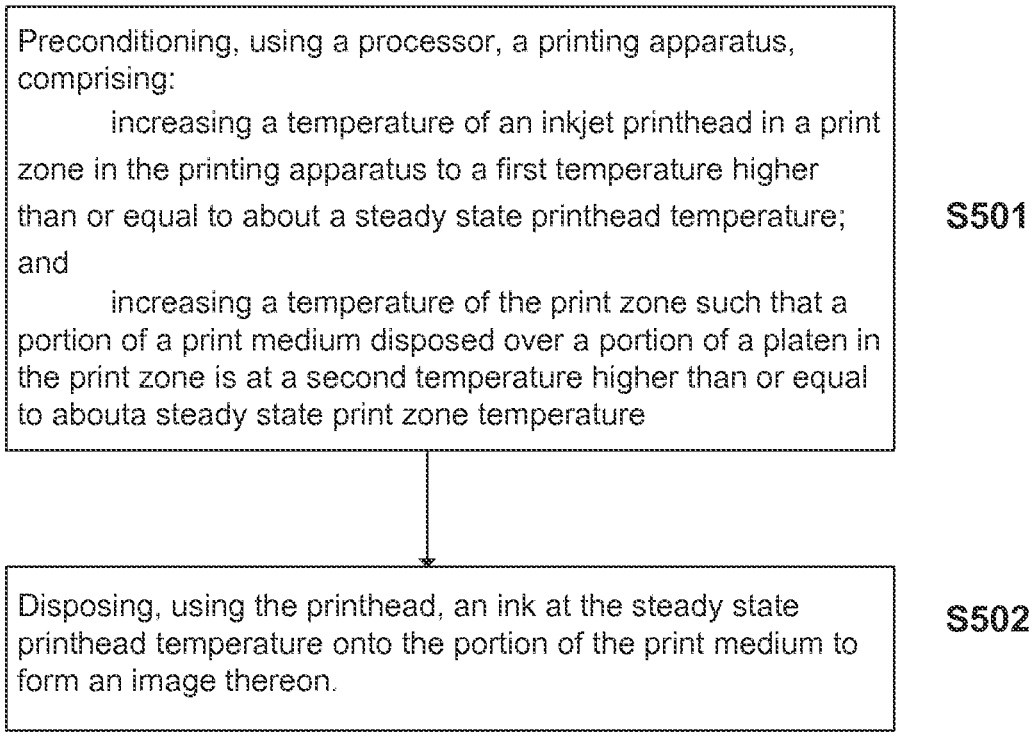
FIG. 5 provides a flowchart showing an example method caused by example machine-readable instructions described herein.

FIG. 5 shows an example of a method executable by example machine-readable instructions. The instructions may cause preconditioning, using a processor, a printing apparatus (S501). In one example, the processor refers to the electronic controller as shown in FIG. 1. The preconditioning may comprise increasing a temperature of an inkjet printhead in a print zone in the printing apparatus to a first temperature higher than or equal to about a steady state printhead temperature. The preconditioning may further comprise increasing a temperature of the print zone such that a portion of a print medium disposed over a portion of a platen in the print zone is at a second temperature higher than or equal to about a steady state print zone temperature. The first temperature, second temperature, steady state printhead temperature, and steady state print zone temperature, may be those described herein. The instructions may further cause disposing, using the printhead, an ink at the steady state printhead temperature onto the portion of the print medium to form an image thereon (S502).

Printed Articles

Employing the apparatus and method described herein may help reduce, or even minimize, the challenges faced with printing a long print job (e.g., several meters) described herein. For example, the method, particularly the preconditioning, would take a small amount of time, relatively to some of the pre-existing methods. The print medium waste may also be reduced, as described above. In one example, the printing method described herein need not involve a primer plot. Further, the color consistency may be higher than pre-existing techniques.

The color consistency may be described using any suitable metrics. One example of such a metric is delta E. Delta E is an industry standard defined by International Commission of Illumination ("CIE"). Delta may be calculated based on the Euclidian distance between two points in a three dimensional space. This space in this case is the LAB color space. Specifically, delta E ("ΔE") may be calculated by:

$$\Delta E = \sqrt{\left(\frac{\Delta L'}{K_L S_L}\right)^2 + \left(\frac{\Delta C'}{K_C S_C}\right)^2 + \left(\frac{\Delta H}{K_H S_H}\right)^2 + R_T\left(\frac{\Delta C'}{K_C S_C}\right)\left(\frac{\Delta H'}{K_H S_H}\right)},$$

where a hue rotation term ($R_T$) is to deal with the problematic blue region (hue angles in the neighborhood of 275°); compensation for neutral colors (the primed values in the L*C*h differences); compensation for lightness ($S_L$); compensation for chroma ($S_C$); and compensation for hue ($S_H$). The $k_L$, $k_C$, and $k_H$ are usually unity. The definition of delta E in this example is explained in the standard CIEDE2000 by CIE.

The value of delta E in the printed article (e.g., printed print medium) may have any suitable value, depending on the apparatus and process parameters employed. Such a delta E may have a value lower than one resulted from a printing method not as described herein, particularly one without the preconditioning. For example, for a certain length the image formed by the method described herein may be at least about 10%—e.g., at least about 20%, about 30%, about 40%, or more, lower than one formed by a printing method otherwise without the preconditioning. Other values are also possible. The length may be between about 20 m and about 60 m—e.g., between about 30 m and about 50 m, between about 35 m and about 45 m, etc. Other values are also possible. In one example, the length is about 45 m.

Not to be bound by any particular theory, but the benefits of the printing method described herein may be explained as follows: two factors may affect the color consistency in the long job: ink drop size difference along the slowly warming up of the printheads during the long job and ink-medium interaction difference when the printing apparatus is cold or warm. In one example, at the beginning of printing, because the printheads and the printing apparatus as a whole are cold, the color is deviated that from the steady state condition. However, once the system enters the steady state, the color difference is much less. The temperature difference thus results in color inconsistency. The method descried herein may mitigate this difference. For example, the preconditioning of the printhead may allow the base temperature of the printheads to reach to the similar level as the steady state before printing commences. Also, the preconditioning of the print zone may allow the print medium and platen to approach to the steady state earlier, thereby assuring a more uniform temperature along the long job.

It should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The indefinite articles "a" and "an," as used herein in this disclosure, including the claims, unless clearly indicated to the contrary, should be understood to mean "at least one." Any ranges cited herein are inclusive.

The terms "substantially" and "about" used throughout this disclosure, including the claims, are used to describe and account for small fluctuations, such as due to variations in processing. For example, they may refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

What is claimed:

1. A method, comprising:

preconditioning a printing apparatus, comprising:

increasing a temperature of an inkjet printhead in a print zone in the printing apparatus to a first temperature higher than a steady state printhead temperature; and increasing a temperature of the print zone such that a portion of a print medium disposed over a portion of a platen in the print zone is at a second temperature higher than about a steady state print zone temperature; and disposing, using the printhead, an ink at the steady state printhead temperature onto the portion of the print medium to form an image thereon.

2. The method of claim 1, wherein increasing the temperature of the inkjet printhead involves trickle warming.

3. The method of claim 1, wherein increasing the temperature of the inkjet printhead involves trickle warming having a cascading way of different trickle warming settings.

4. The method of claim 1, wherein increasing the temperature of the inkjet printhead involves trickle warming having fixed trickle warming settings.

5. The method of claim 1, wherein the first temperature is sufficiently high such that the steady state printhead temperature is reached in less than or equal to about 2 minutes since beginning of increasing the temperature of the inkjet printhead.

6. The method of claim 1, wherein the steady state printhead temperature is between about 45° C. and about 65° C.

7. The method of claim 1, wherein increasing the temperature of the print zone involves heating, using an energy source, the portion of the print medium and the portion of the platen to the second temperature.

8. The method of claim 1, wherein the steady state print zone temperature is between about 25° C. and about 40° C.

9. The method of claim 1, wherein the preconditioning takes less than or equal to about 3 minutes.

10. The method of claim 1, wherein for a length of between about 30 m and about 50 m the image has a delta E ("DE") value that is at least about 30% lower than one formed by a printing method otherwise without the preconditioning.

11. The method of claim 1, wherein increasing the temperature of the print zone is performed before the disposing of the ink using the printhead.

12. A non-transitory machine-readable medium stored thereon instructions, which when executed, cause preconditioning, using a processor, a printing apparatus, comprising:

increasing a temperature of an inkjet printhead in a print zone in the printing apparatus to a first temperature higher than a steady state printhead temperature; and increasing a temperature of the print zone such that a portion of a print medium disposed over a portion of a platen in the print zone is at a second temperature higher than about a steady state print zone temperature; and disposing, using the printhead, an ink at the steady state printhead temperature onto the portion of the print medium to form an image thereon.

13. The non-transitory machine-readable medium of claim 12, wherein increasing the temperature of the inkjet printhead involves trickle warming.

14. The non-transitory machine-readable medium of claim 12, wherein the portion of the platen is at the second temperature.

15. The non-transitory machine-readable medium of claim 12, wherein for a length of between about 30 m and about 50 m the image has a delta E ("DE") value that is at least about 20% lower than one formed by a printing method otherwise without the preconditioning.

16. A printing apparatus, comprising:

a print zone, in which a heater is to increase a temperature of a printhead to a first temperature higher than a steady state printing temperature; and a heating device to increase a temperature of the print zone such that a portion of a print medium disposed over a portion of a platen in the print zone is at a second temperature higher than about a steady state print zone temperature;

wherein the printhead is to dispose an ink at the steady state printing temperature onto the portion of the print medium to form an image thereon.

17. The method of claim 1, wherein the first temperature is higher than the second temperature, such that inkjet printhead is heated to a higher temperature than the print zone.

18. The printing apparatus of claim 16, wherein the first temperature is higher than the second temperature, such that inkjet printhead is heated to a higher temperature than the print zone.

19. The printing apparatus of claim 16, wherein the heating device is to increase the temperature of the print zone before the printhead is to dispose an ink.

* * * * *